US012673354B1

(12) United States Patent
Jordan et al.

(10) Patent No.: US 12,673,354 B1
(45) Date of Patent: Jul. 7, 2026

(54) WIDTH-EXPANDABLE SHOE FOR CONDUIT BENDING APPARATUS AND AN ASSOCIATED METHOD

(71) Applicants: David S. Jordan, Clinton, TN (US); Michael C. Jordan, Heiskell, TN (US); Scott M. Jordan, Powell, TN (US)

(72) Inventors: David S. Jordan, Clinton, TN (US); Michael C. Jordan, Heiskell, TN (US); Scott M. Jordan, Powell, TN (US)

(73) Assignee: 'iTool Equipment Holding LLC, Clinton, TN (US)

( * ) Notice: Subject to any disclaimer, the term of this patent is extended or adjusted under 35 U.S.C. 154(b) by 350 days.

(21) Appl. No.: 18/445,527

(22) Filed: Sep. 22, 2023

(51) Int. Cl.

| | |
|---|---|
| ***B21D 7/024*** | (2006.01) |
| ***B21D 7/02*** | (2006.01) |
| ***B21D 7/022*** | (2006.01) |
| *B21D 7/06* | (2006.01) |

(52) U.S. Cl.
CPC ..... *B21D 7/024* (2013.01); *B21D 7/021* (2013.01); *B21D 7/022* (2013.01); *B21D 7/06* (2013.01)

(58) Field of Classification Search
CPC ..... B21D 7/021; B21D 7/022; B21D 7/025; B21D 7/024; B21D 7/16
See application file for complete search history.

(56) References Cited

U.S. PATENT DOCUMENTS 4,025,749 A * 5/1977 Spurr ..... B23K 11/062 219/84
4,546,632 A * 10/1985 Van Den Kieboom ..... B21D 7/022 72/158
5,187,963 A * 2/1993 Sutton, Jr. ..... B21D 7/02 72/157
5,226,305 A * 7/1993 Adleman ..... B21D 7/024 72/157
5,284,041 A * 2/1994 Christensen ..... B21D 7/021 72/157
5,337,590 A * 8/1994 Schuchert ..... B21D 7/02 72/157
11,400,503 B2 8/2022 Plummer et al.
2010/0223971 A1* 9/2010 Jaubert ..... B21D 7/024 72/149

(Continued)

FOREIGN PATENT DOCUMENTS

| | | | | |
|---|---|---|---|---|
| CN | 112893549 A * | 6/2021 | ..... | B21D 7/024 |
| EP | 1561522 A1 * | 8/2005 | ..... | B21D 7/024 |
| SU | 1593731 A1 * | 9/1990 | | |

*Primary Examiner* — Jared O Brown
(74) *Attorney, Agent, or Firm* — Michael E. McKee

(57) ABSTRACT

A conduit bending apparatus having a shoe mounted for rotation about an axis and having an arcuate-shaped periphery defining an outwardly-opening groove having sidewalls for closely accepting the outer surface of a conduit desired to be bent utilizes a shoe comprised of a pair of platen half-sections which are joined in a side-by-side relationship and which collectively define the outwardly-opening groove. In addition, the groove has a width as measured laterally across the opening thereof, and the pair of half-sections are joined together in a manner which permits the pair of half-sections to be moved toward and away from one another to alter the width of the outwardly-opening groove so that the outwardly-opening groove can closely accept the outer surface of a conduit having a width which falls within a range of outer diameters.

19 Claims, 6 Drawing Sheets

(56) References Cited

U.S. PATENT DOCUMENTS

2016/0354822 A1* 12/2016 Nozu ..... B21D 37/145
2017/0291206 A1* 10/2017 Elder ..... B21D 7/063

* cited by examiner

WIDTH-EXPANDABLE SHOE FOR CONDUIT BENDING APPARATUS AND AN ASSOCIATED METHOD

BACKGROUND OF THE INVENTION

This invention relates generally to means and methods for forming a bend in a straight conduit of cylindrical shape and relates, more particularly, to conduit bending apparatus used to form such a bend and to a method of using such apparatus.

The class of conduit bending apparatus with which this invention relates utilizes a conduit bending shoe having an outer periphery which is arcuate in shape and is engagable with a conduit desired to be bent and which is mounted upon a frame for rotation about an axis. Commonly, the arcuate-shaped periphery of the shoe defines at least one outwardly-opening groove which is U-shaped in cross section and whose opening is adapted to closely accept a portion of the outer surface of the conduit desired to be bent. By positioning the shoe against the conduit so that the conduit is accepted by the outwardly-opening groove and then pressing the roller against the conduit while simultaneously rotating the shoe about its rotation axis so that the outer periphery of the shoe moves in rolling engagement along the length of the conduit, a bend is formed in the conduit whose curvature substantially corresponds to the curvature of the shoe periphery.

An example of a conduit bending apparatus of the aforedescribed class is shown and described in U.S. Pat. No. 11,400,503, the disclosure of which is incorporated herein by reference. The conduit bending shoe of this referenced patent includes a set of four arcuate-shaped channels, or grooves, which are each adapted to closely accept the outer surfaces of conduits having an outer diameter (as measured laterally across the opening of the conduit-accepting groove) of a) two inches, b) one and one-half inches, c) one and one-quarter inches and d) one inch, respectively.

For proper operation of bending apparatus of the aforedescribed class, the sidewalls of a outwardly-opening groove of the shoe must closely hug the outer surface of the conduit being bent. This is because when a bend is formed along the length of the conduit, one-half of a radial cross section of the conduit being bent (i.e. the half closer to the center of the radius of the bend being formed) is exposed to compressive forces while the other, or opposite, one-half of the radial cross section of the conduit being bent (i.e. the half further from the center of the radius of the bend being formed) is exposed to tension forces. Therefore and unless the sidewalls of the outwardly-opening groove closely support, or back, the outer surface of the conduit, the forces (either compressive or tension forces) to which the conduit is exposed could cause an undesirable crimp, kink or wrinkle to form in the conduit during the bending operation. Consequently, a conduit bending apparatus should utilize a conduit bending shoe whose outwardly-opening groove closely matches the outer diameter of the conduit being bent. Preferably, the outer diameter of the conduit-accepting groove sized to accept a conduit having an outer diameter (or trade size) of between 0.5 inches and 2.0 inches must possess a width which is no greater than about 0.005 to 0.05 inches of the outer diameter of the conduit being bent in order to substantially eliminate the likelihood of damage to a conduit being bent by the conduit-accepting groove.

Currently, the outer diameters of conduits capable of being bent with bending apparatus of the aforedescribed class will vary depending upon the material (or materials) comprising the conduit. For example, there is provided below a chart depicting the actual outer diameters (in inches) for RMC (Rigid metallic conduit), IMC (Intermediate metallic conduit) and EMT (Electrical metallic tubing) having a conduit trade size of between 0.5 inches to 2.0 inches:

| Trade Size | RMC | IMC | EMT |
|---|---|---|---|
| 0.5 | 0.84 | 0.815 | 0.706 |
| 0.75 | 1.05 | 1.029 | 0.922 |
| 1.0 | 1.315 | 1.29 | 1.163 |
| 1.25 | 1.66 | 1.638 | 1.51 |
| 1.5 | 1.9 | 1.883 | 1.74 |
| 2.0 | 2.375 | 2.36 | 2.197 |

Similar charts are available from various conduit manufacturers for RAC (rigid aluminum conduit), conduits comprised of stainless steel and PVC-coated conduit.

The point being made here is that the outer diameters of conduits capable of being bent with conduit bending equipment to which the present invention should be compared are varied and spread over a relatively large range. Consequently and heretofore, an operator of a conduit bending apparatus of this class who is required to bend conduits of different sizes and/or material compositions should also have on hand shoes having conduit-accepting grooves whose widths closely match the outer diameter of every conduit expected to be bent. In practice, such a requirement may necessitate that the operator possess a large number of shoes with conduit-accepting grooves of different widths.

It would be desirable to provide a conduit bending shoe for a conduit-bending apparatus of the aforedescribed class whose outwardly-opening groove defined along the outer periphery of the shoe is not limited for use when bending a conduit whose outer diameter is of a particular, or specific, size and instead, is capable of being used when bending a conduit having an outer diameter which falls within a range of outer diameters.

Another object of the present invention is to provide such a conduit bending shoe whose outwardly-opening groove has a width which is capable of expanding in size from an original width for accepting a conduit having an outer diameter which falls within a range of diameters.

Still another object of the present invention is to provide such a conduit bending shoe whose outwardly-opening groove is capable of expanding in size from an original width for the purpose of adapting, or conforming, the groove to the size of the conduit desired to be bent, even though the conduit may be sightly larger than the original, or unexpanded, size, or width, of the outwardly-opening groove.

Yet another object of the present invention is to provide such a conduit-bending shoe which obviates the need that an operator of the conduit bending apparatus of the aforedescribed class have on hand a large number of shoes whose outwardly-opening groove is capable of closely accepting a conduit possessing a preselected outer diameter.

One more object of the present invention is to provide such a conduit bending shoe which is relatively uncomplicated in structure, yet effective in operation.

Still one more object of the present invention is to provide a new and improved method for bending a conduit with the apparatus of the present invention.

SUMMARY OF THE INVENTION

This invention resides in an improvement to a conduit bending apparatus and a method of use wherein the apparatus includes a conduit-bending shoe mounted for rotation about an axis and has an arcuate-shaped periphery defining an outwardly-opening groove having opposing sidewalls for accepting the outer surface of a conduit desired to be bent. Furthermore, the outwardly-opening groove has a width as measured across the opening thereof and which is sized to accept the outer surface of a conduit having a predetermined outer diameter so that by positioning the outwardly-opening groove of the shoe against a conduit having a predetermined outer diameter so that the outer surface of the conduit is accepted by the sidewalls of the outwardly-opening groove and then pressing the shoe against the conduit while rotating the shoe about its axis of rotation so that the outwardly-opening groove rolls along the length of the conduit, a bend is formed in the conduit.

The improvement to the apparatus is characterized in that the width of the outwardly-opening groove of the shoe is capable of expanding in size to enable the groove to closely accept the outer surface of a conduit whose outer diameter is greater than the predetermined outer diameter.

The improvement to the method of the invention is characterized in that the step of pressing the outwardly-opening groove of the shoe against the conduit includes a simultaneous step of expanding the width of the outwardly-opening groove of the shoe to enable the groove to closely accept the outer surface of a conduit having a diameter which is greater than the predetermined outer diameter.

DETAILED DESCRIPTION OF THE ILLUSTRATIVE EMBODIMENTS

Figure 1:
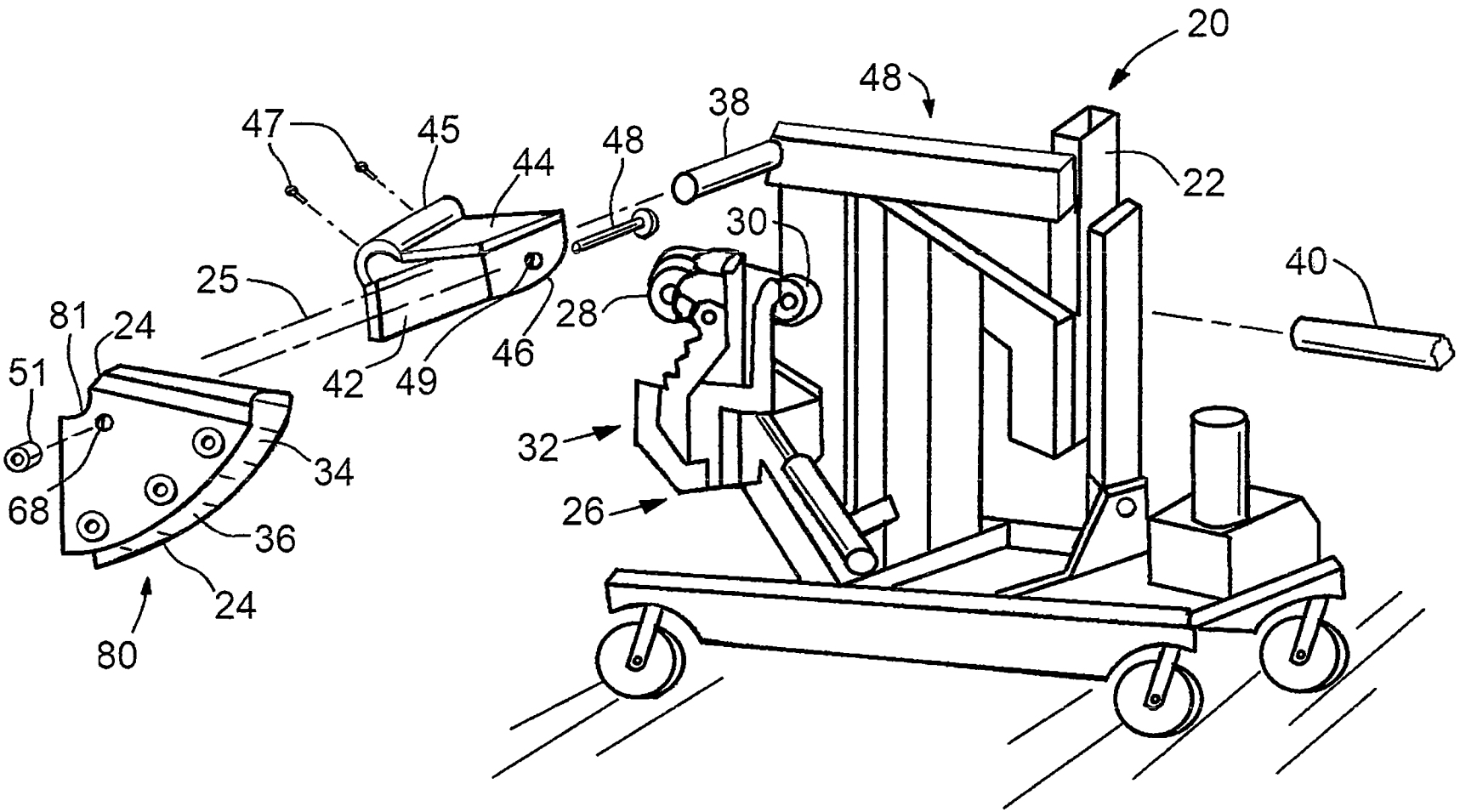
FIG. 1 is a perspective view of a conduit bending apparatus within which features of the present invention are incorporated, shown exploded.

Turning now to the drawings in greater detail and considering first FIG. 1, there is schematically illustrated a power bending apparatus, generally indicated 20, within which features of the present invention are incorporated and which is capable of bending a conduit 40 of cylindrical shape. Briefly, the bending apparatus 20 includes a frame 22 and a conduit bending shoe, or shoe assembly, 24 which is mounted for rotation upon the frame 22 about a substantially horizontal axis 25 and a pressure roller assembly 26 which is supported by the frame 22 beneath the shoe 24. The pressure roller assembly 26 includes a plurality of rollers 28, 30 which are horizontally spaced from one another and which are supported for rotation about parallel axes which are each disposed substantially parallel to the horizontal axis 25 about which the shoe 24 is permitted to rotate during a conduit bending operation.

The shoe 24 of the depicted apparatus 20, described in greater detail herein, has a peripheral edge 34 which defines an outwardly-opening groove 36 which is substantially U-shaped in cross section and whose U-shape opens radially away from the rotation axis 25 of the shoe 24 for closely accepting the outer surface of a conduit 40 (FIG. 1) desired to be bent by the bending apparatus 20. As used herein, the phrase closely accepting is intended to mean that the outwardly-opening groove 36 is fitted about a conduit in a snug relationship so that the width of the groove opening closely matches the outer diameter of the conduit about which the groove 36 is positioned. In practice—and for conduits having a trade size of 2.5 inches, the width of the outwardly-opening groove 36, when in an expanded condition (if necessary) and positioned about the outer surface of a conduit, does not exceed the actual outer diameter of the conduit by more than about 0.05 inches.

Meanwhile, the pressure rollers 28, 30 are mounted upon a linkage assembly, generally indicated 32, to permit the pressure rollers 28, 30 to be bodily moved (e.g. manually or hydraulically) relative to the base frame 22 between a lowered position (i.e. a condition of non-use) and a raised position (i.e. a condition of use) at which the spaced-apart pressure rollers 28, 30 are disposed beneath and in relatively close proximity to the peripheral edge 34 of the shoe 24.

The apparatus 20 further includes a horizontally-disposed, cylindrically-shaped load bar 38 upon which the shoe 24 is mounted for rotation about the rotation axis 25. A pair of support plates 42, 44 are arranged in the shape of a V and held thereat by way of a member 45 which is sized to accept (a portion of) the load bar 38 and are fixedly secured about the load bar 38 by way of set screws 47 which extend through the member 45 so that the support plates 42, 44 must rotated with the load bar 38 about the rotation axis 25, and an end plate 46 is secured across one end of the pair of plates 42, 44 to effectively cap one end of the V-shaped arrangement thereof. The As will be apparent herein, the shoe 24 is captured between the V-shaped arrangement of plates 42, 44 and bolted to the end plate 46 to thereby slave the shoe 24 to the load bar 38 so that rotation of the load bar 38 about the rotation axis 25 effects a corresponding rotation of the shoe 24 about the axis 25.

The apparatus 20 also includes means, generally indicated 48 in FIG. 1, for forcibly rotating the load bar 38 about the rotation axis 25. Such rotating means 48 can take any of a number of forms, such as electrically or hydraulically-operated means for providing rotating power to the load bar 38. Moreover, such rotating means 48 can be connected to the load bar 38 by way of suitable linkage assemblies (not shown) so that actuation of an electric motor or a hydraulic cylinder effects the forced rotation of the load bar 38 (and the shoe 24 supported thereby) about the rotation axis 25. Electrical power, if needed for operation of the apparatus 20, can be supplied by way of a cord capable of being plugged into an electrical outlet or can be supplied by way of a battery pack to render the apparatus 20 cordless.

The operation of a conduit bending apparatus 20 (of the class to which this invention relates) is well known in the art so that a detailed description of its operation is not believed to be necessary. Suffice it to say that a cylindrical conduit 40 (FIG. 1) which is desired to be bent is positioned lengthways across the upwardly-facing surfaces of the spaced-apart pressure rollers 28, 30, and the roller assembly 26, with the spaced-apart pressure rollers 28, 30, are bodily moved from the lowered condition of non-use to the raised condition of use (as shown in FIG. 1) at which the conduit 40 is held, or squeezed, between the upwardly-facing surfaces of the pressure rollers 28, 30 of the roller assembly 26 and the arcuate edge 34, or more specifically, the surface of the outwardly-opening groove 36, of the shoe 24. By maintaining pressure downwardly upon the conduit 40 (by way of the shoe 24) and simultaneously rotating the shoe 24 about its rotation axis 25 so that its arcuate edge 34 rolls, or moves axially, relative to and along the length of the conduit 40, a bend is formed in the conduit 40 which approximates the curvature of that of the arcuate edge 34 of the shoe 24. It will be understood that the rotation axis 25 of the shoe 24 is intended to remain stationary throughout a conduit bending operation while the conduit 40 is pulled endwise beneath the shoe 24 as the downwardly-applied pressure of the shoe 24 maintains the shoe 24 in frictional gripping engagement with the conduit 40.

For a more detailed description of the operation of a known conduit bending apparatus of the class to which the depicted apparatus 20 can be compared (i.e. one which utilizes a conduit bending shoe and spaced-apart rollers across which the conduit to be bent is positioned), reference can be had to the conduit bending apparatus which is shown and described in earlier-referenced U.S. Pat. No. 11,400,503, the disclosure of which is incorporated herein by reference.

A conduit 40 which is capable of being bent with the bending apparatus 20 can constructed of any of a number of materials, such as steel, stainless steel or aluminum and can be coated with a suitable coating, such as PVC (polyvinyl chloride). The bending apparatus 20 is capable of bending conduit commonly utilized for sheathing electrical wires routed through the center of the conduit. Accordingly, the classes of conduits capable of being bent by the apparatus 20 include, but are not limited to, EMT (electrical metal tubing), IMC (intermediate metal conduit), RAC (rigid aluminum conduit), stainless steel, and PVC coated conduit.

Figure 3:
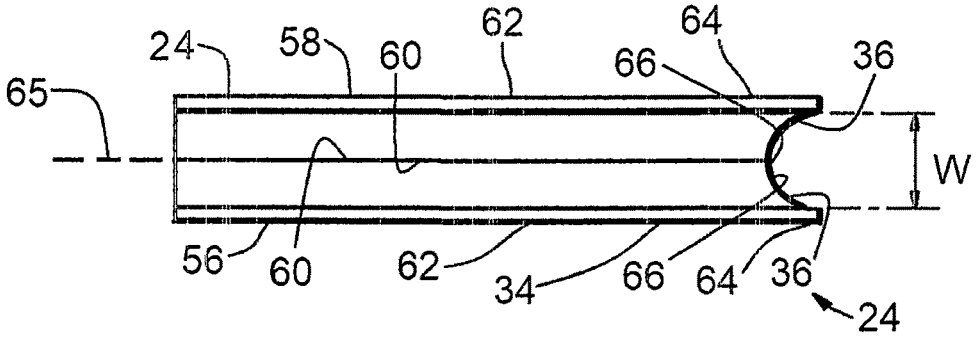
FIG. 3 is an end elevation view of the two half-sections of the shoe of FIG. 2, shown positioned in a side-by-side, or layup, arrangement before assembly.
Figure 6:
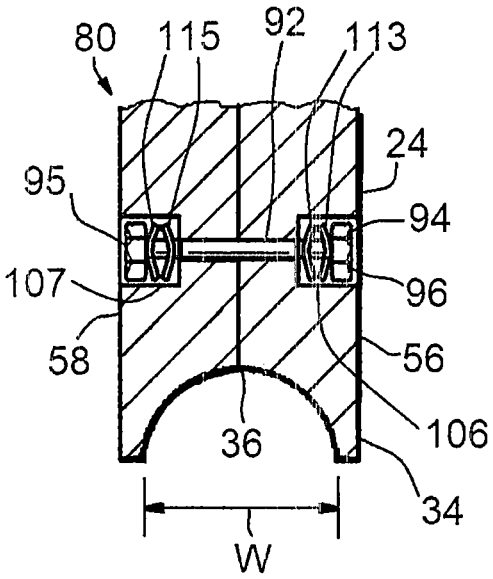
FIG. 6 is a view of a fragment of the cross-sectional view of the shoe depicted in FIG. 5, when assembled.

With reference to FIGS. 3 and 6 and for a reason which will be apparent herein, the radially outwardly-opening groove 36 of the shoe 24 has an original, or unexpanded, width W (as measured laterally across the opening of the groove 36) which is capable of expanding in size to closely accept a conduit having a diameter which is greater than the original width W of the groove 36. In this connection, the shoe 24 is comprised of a plurality of, or multiple, sections (described herein) which are joined together adjacent the arcuate-shaped peripheral edge 34 of the shoe 24 and which collectively define the outwardly-opening groove 36 of the shoe 24. Furthermore, the multiple sections are capable of moving relative to one another (e.g. moving further apart) from the original, or unexpanded, condition (as viewed in FIG. 3) to thereby increase the width of the outwardly-opening groove 36 from the original width W. As will be apparent herein, the capacity of the shoe 24 to expand in width enables the outwardly-opening groove 36 to snugly or closely accept, the outer surface of a conduit whose diameter falls within a range of outer diameters and more specifically, a conduit whose diameter is greater than the original width W.

Figure 2:
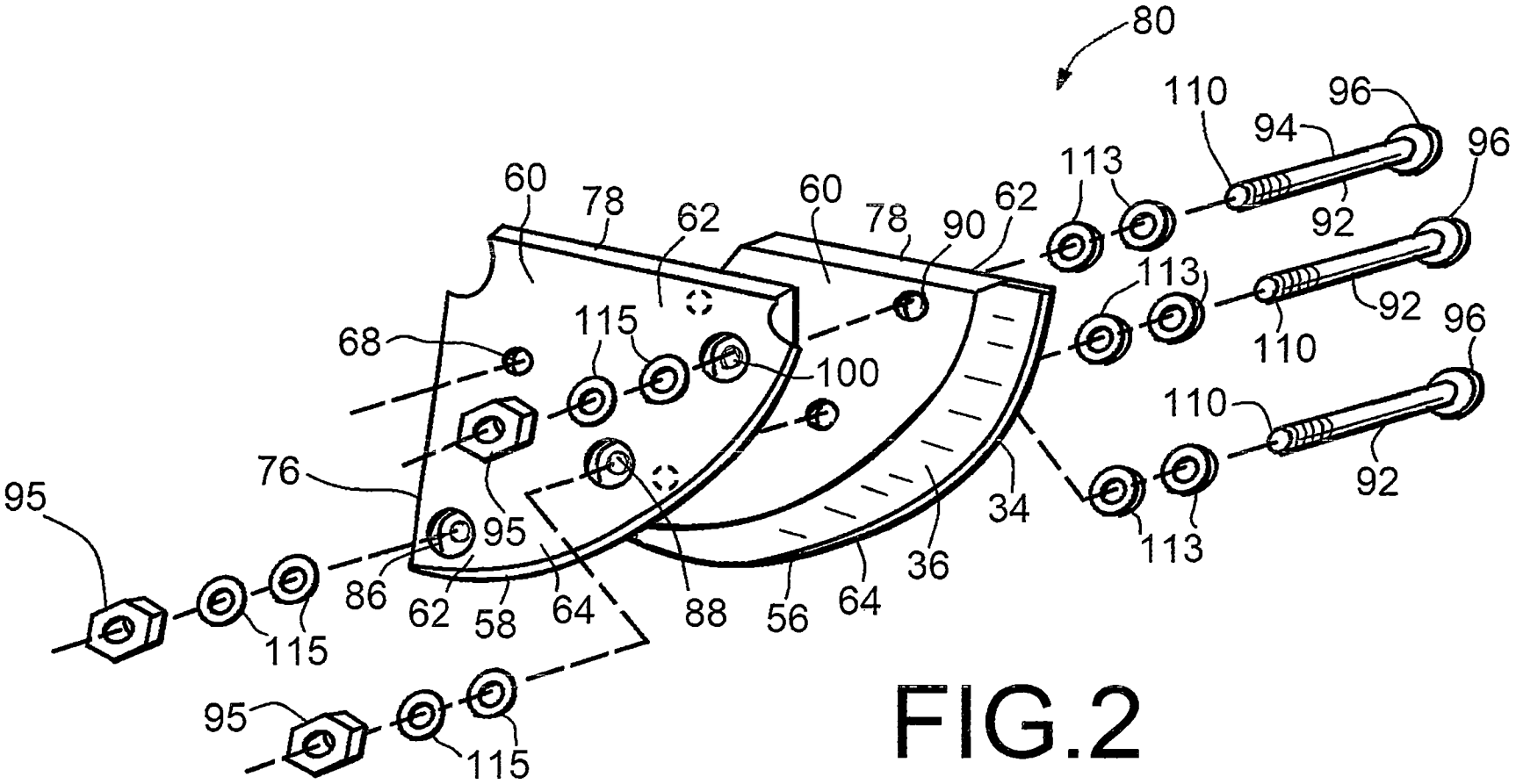
FIG. 2 is a perspective view of the conduit bending shoe of the FIG. 1 apparatus, shown exploded.
Figure 4:
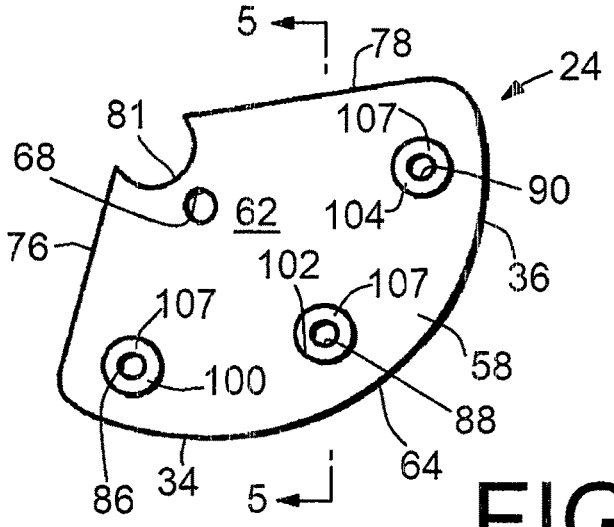
FIG. 4 is a top plan view of the two half-sections of the FIG. 2 shoe, as seen from above in FIG. 3.

Within the depicted apparatus 20 and with reference to FIGS. 2-5, the shoe 24 includes a pair of platen half-sections 56, 58 which each define two opposite sector-shaped side surfaces 60, 62 and an arcuate periphery 64 which defines an outwardly-opening groove 66 (FIG. 3) whose cross-section resembles (in appearance) the shape of a C. When the half-sections 56, 58 are positioned in a side-by-side, or lay-up, relationship with one another (as best shown in FIGS. 2 and 3) so that the side surfaces 60 thereof are positioned in opposition to (and flushly engage) one another (as best shown in FIG. 3), the C-shaped grooves 66 defined along the sector peripheries 64, 64 cooperate to collectively define the outwardly-opening U-shaped groove 36 which extends along the entirety of the arcuate peripheral edge 34 of the shoe 24. Meanwhile, the outwardly-opening groove 36 is provided with two opposing sidewalls 50 and 52, and the C-shaped groove 66 of one half-section 56 defines the conduit-engaging surface of one sidewall 50 of the groove 36, and the C-shaped groove 66 of the other half-section 58 defines the conduit-engaging surface of the other sidewall 52 of the groove 36. Meanwhile, each of the platen half-sections 56 or 58 includes planar edges 76 and 78 (FIG. 4) which converge toward one another (from the periphery 64 of the half-sections 56 or 58 to a semi-circular-shaped cutout 81 which accommodates the positioning of the shoe 24 against the cylindrical surface of the load bar 38 when the shoe 24 is mounted thereon.

As will be apparent herein and when the shoe 24 is in a fully assembled (and unexpanded) condition, the half-sections 56, 58 are positioned in the side-by-side, or layup arrangement as shown in FIG. 3, the shoe 24 can be said to define a mid-plane 65 (FIG. 3) which bisects the U-shaped groove 66 along the entire length of the shoe periphery 34, and this mid-plane 65 could be fairly regarded as being parallel to one side surface (i.e. the surface 60) of each half-section 56 or 58). Stated another way and with regard to the FIG. 3 arrangement, one half-section 56 is disposed on one side of the mid-plane 65, and the other half-section 58 is disposed on the other side of the mid-plane 65.

Figure 10:
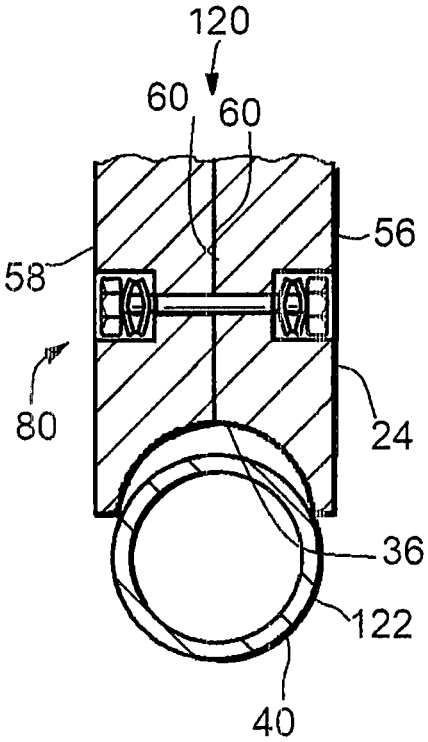
FIGS. 10 and 11 are cross-sectional views of the assembled FIG. 2 shoe as seen in FIG. 6 depicting, in sequence, the expansion in width of the outwardly-opening groove of the FIG. 2 shoe as the opposing sidewalls of the outwardly-opening groove of the shoe are urged downwardly against the outer surface of a conduit having a larger diameter than the original width of the outwardly-directed groove.
Figure 11:
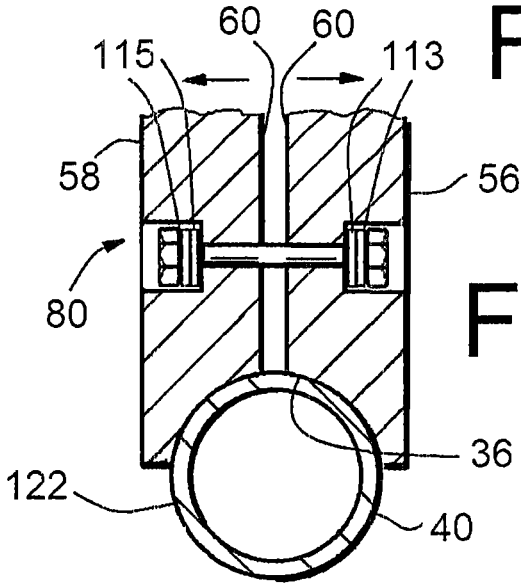
Figure 9:
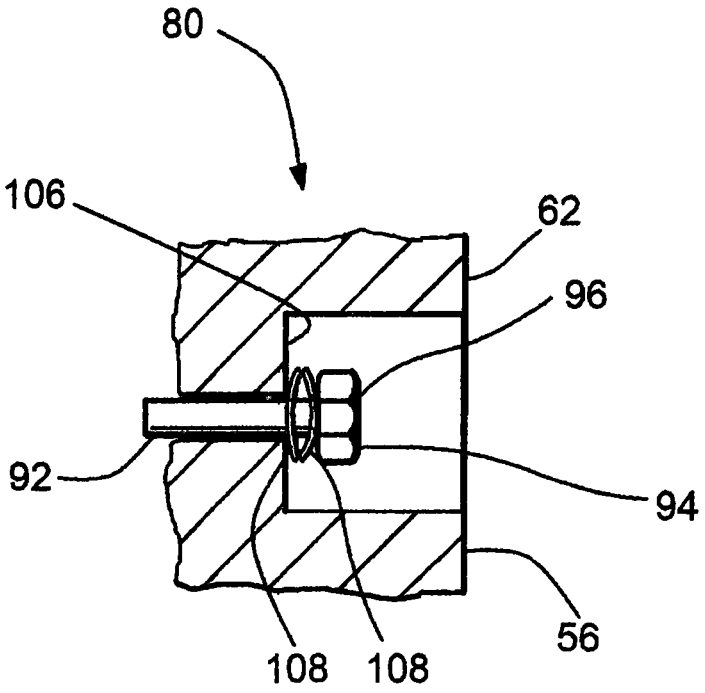
FIG. 9 is view of a fragment of the cross-sectional view of FIG. 6, drawn to a slightly larger scale.

It will also be apparent herein that the two half-sections 56, 58 are joined together in a manner described herein which permits the movement of the half-sections 56, 58 relative to one another between the illustrated FIG. 3 side-by-side condition at which the opposing surfaces 60 of the half-sections 56, 58 are arranged in flush engagement with one another (as shown in FIGS. 3 and 10) and a fully expanded condition, as depicted in FIG. 11, at which the opposing surfaces 60 are spaced from one another.

With reference to FIGS. 2 and 5-11, it is also a feature of the shoe 24 that it includes means, generally indicated 80 in FIGS. 5-11, for continually biasing the half-sections 56, 58 (and in particular, the surfaces 60 thereof) from a fully expanded condition (such as is illustrated in FIG. 11) at which the surfaces 60 are spaced from one another toward the unexpanded condition (as illustrated in FIG. 10). In connection with the foregoing and with reference again to FIG. 2, the half-sections 56, 58 define three sets of aligned through-openings 86, 88, 90 for accepting the shanks, indicated 92, of bolts 94 directed endwise therethrough and which are fastened through the half-sections 56, 58 with a nut 95 which is threaded upon the shank 92 of each bolt 94 opposite the head end thereof. In addition, each side surface 62 of the half-section 56 is provided with a circular recess 101 (best shown in FIG. 5) which is centered about and surrounds a corresponding opening 86, 88 or 90, and each recess 101 is provided with a bottom 106. Similarly, the side surface 62 of the half-section 58 is provided with a circular recess 100, 102 or 104 (best shown in FIG. 4) which is centered about and surrounds a corresponding opening 86, 88 or 90, and each recess 100, 102 or 104 is provided with a bottom 107.

The half-sections 56, 58 also define a fourth set of aligned through-openings 68 (FIG. 2) adjacent the cutout 81 for purposes of securing the shoe 24 to the load bar 38 by way of the earlier-described arrangement of support and end plates 42, 44, 46 which are fixedly secured to the load bar 38. In this connection, the end plate 46 defines a through-opening 49 (FIG. 1), and the shoe 24 is positioned within the V-shaped arrangement formed between the support plates 42 and 44, and the shoe 24 is positioned against the end plate 46 so that the set of aligned through-openings 68 provided in the half-sections 56, 58 are aligned with the through-opening 49 provided in the end plate 46. A bolt 55 (FIG. 1) is then directed shank-end-first through the aligned through-openings 49 and 68, and a nut 51 is tightly secured about the shank of the bolt 48 opposite the head end thereof. It follows that with the support and end plates 42, 44 and 46 fixedly secured to the load bar 38 (and captured between the support plates 42 and 44) and the shoe 24 fixedly secured to the end plate 46, the shoe 24 is slaved to the load bar 38 so that forced rotation of the load bar 38 about the rotation axis 25 effects the forced rotational movement of the shoe 24 about the rotation axis 25.

As will be apparent herein, each of the three bolts 94 (FIG. 2) is directed through a corresponding set of aligned through-openings 86, 88, 90 (FIG. 2) for joining the half-sections 56 and 58 together between the head, indicated 96, of the bolt 94 and a nut 95, and the biasing means 80 includes a compression-style spring 108 having a central opening 109 (FIGS. 7 and 8) through which the shank 92 of a bolt 94 extends. More specifically and with reference to FIGS. 8 and 9, the spring 108 has two opposite ends (or side faces 116, 118) which are spaced from one another along the shank 92 of the bolt 94 and is adapted to resist compressive forces which squeeze, or compress, the body of the spring 108 between the opposite ends thereof toward a flattened condition.

One spring washer which is suitable for use as the spring washer 108 is referred to in the art as a Belleville spring washer and is available from W.W. Grainger, Inc. of Lake Forest, Illinois under Catalogue Item 22RD19, but other classes of spring washers, such as those known in the industry as wave washers or lock washers can be used as the spring 108.

Within the shoe 24 of the depicted conduit bending apparatus 20, the spring washer 108 of the biasing means 80 is provided by a first pair of spring washers 113 and a second pair of spring washers 115 which are each positioned about the shank 92 of a bolt 94 for acting between the opposite ends of the bolts 92. As will be apparent herein, each spring washer of the two pairs of spring washers 113, 115 possesses an inherent resiliency so that the bodies of the washers 113, 115 resist (and thus oppose) compressive forces which tend to deform the sashers 113, 115 toward a flattened condition (as best viewed in FIG. 11). It follows that each spring washer 113 or 115 is provided with an original thickness when in an undeformed condition but possesses a smaller thickness (i.e. a thickness which is smaller than the original thickness) when its opposite side faces are squeezed together toward a flattened condition. Consequently, when positioned about the shank 92 of a bolt 94 and before the washers 113, 115 are pressed toward a flattened condition), each washer 113 or 115 provides a spacer of predetermined thickness along the shank 92 of the bolt 94 (i.e. between the head, indicated 96, of the bolt 94 and the nut 95 which is screwed upon the shank end of the bolt 94). Such a spacing, or thickness, is, of course, reduced when the opposite side faces of the washers 113, 115 are pressed toward a flattened condition.

Figure 5:
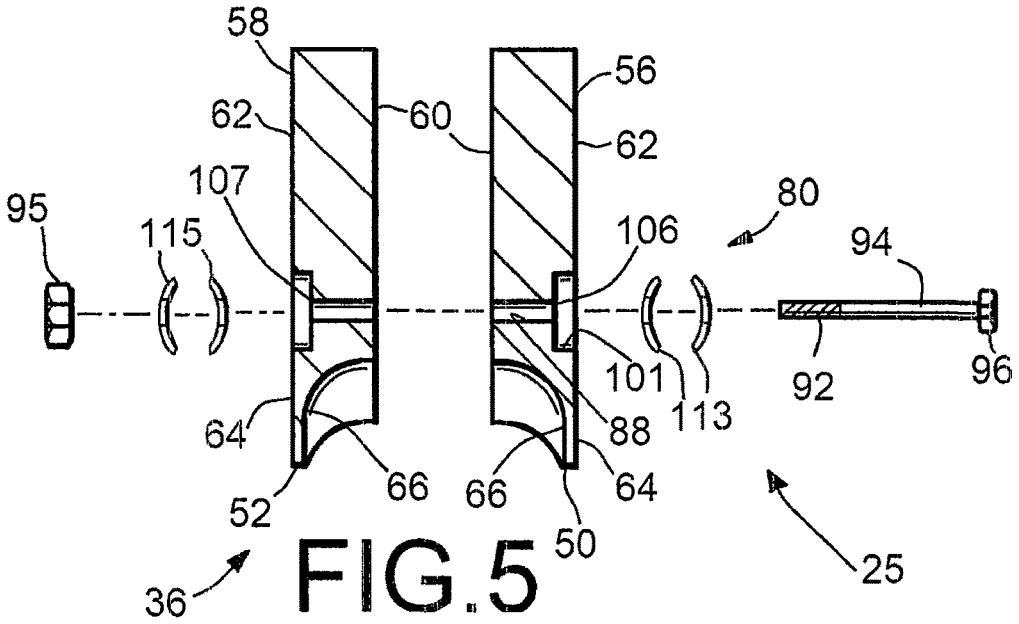
FIG. 5 is a cross-sectional view of the FIG. 2 shoe taken along line 5-5 of FIG. 3 and illustrating a fastener and spring washers used for joining the two half-sections of the shoe together.
Figure 8:
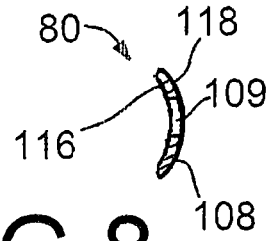
FIG. 8 is a cross-sectional view of the washer of FIG. 7 taken along line 8-8 of FIG. 7.
Figure 7:
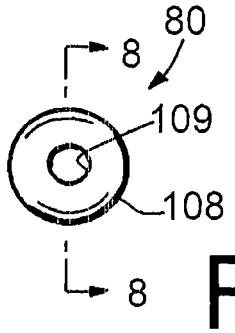
FIG. 7 is an side elevation view of an exemplary spring washer used when joining the two half-sections of the FIG. 2 shoe together.

When assembling the shoe 24 and with reference to FIGS. 2 and 5, the first pair of spring washers 113 are positioned about the shank 92 of each of the three bolts 94, and then each of the three bolts 94 is directed shank-end-first into a corresponding set of openings 100, 102 or 104 until the first pair of washers 113 (which are positioned about the bolt shank 92) come to rest against the bottom 106 of the corresponding recess 101 which opens out of the half-section 56 so that the washers 113 are positioned against the recess bottom 106 and the head 96 of the bolt 94. The second pair of spring washers 115 are then positioned about the end, indicated 110, of the bolt shank 92 opposite the head 96 which protrudes out of the half-section 58 by way of the corresponding set of through-openings 86, 88 or 90, and then a nut 95 is screwed about the end 110 of the bolt shank 92. As exemplified by the assembled arrangement of the shoe 24 depicted in FIG. 6, the first pair of washers 113 are captured about the bolt shank 92 between the head 96 of the bolt 94 and the recess bottom 106, and the second pair of washers 115 are captured about the bolt shank 92 between the nut 95 and the bottom 107 of a corresponding recess 100, 102 or 104 (FIG. 4) which opens out of the surface 62 of the half-section 58.

As best shown in FIG. 6, the nuts 95 are preferably tightened about the bolts 94 only to the point that the washers 113, 115 of each pair of spring washers are held in a stationary condition along the length of the bolt shank 92 and so that the original thickness of each washer 113 or 115, when in an undeformed condition, is substantially preserved. In other words, care is taken not to over-tighten the nuts 95 about the bolt shanks 92 so that the washers 113, 115 are deformed to the FIG. 11 flattened condition.

During a conduit-bending operation and as the sidewalls 50, 52 of the groove 36 of the shoe 24 are urged downwardly (e.g. in the direction of the FIG. 10 arrow 120) against a conduit 40 having an outer diameter which is greater than the original width W (FIG. 6) of the outwardly-opening groove 36, the groove sidewalls 50, 52 of the half-sections 56, 58 (which make the shoe's initial contact with the conduit 40) are forced to slide (e.g. downwardly) along the outer surface, indicated 122 in FIGS. 10 and 11) of the conduit 40 (and on opposite sides thereof) so that the groove sidewalls 50, 52 are forced to spread apart. Such a spreading apart of the sidewalls 50, 52 effects a compressing of the washers 113, 115 toward a flattened condition as the spacing, as measured along the bolt shank 92 between the bolt head 96 and the nut 95, is decreased by a corresponding amount. As the washers 113, 115 are thereby compressed—and due to the inherent resiliency of the washers 113, 115, the washers 113, 115 urge the half-sections 56, 58 toward one another.

It will be understood that as the shoe 24 is rotated about the rotation axis 25 and makes its initial contact with the outer surface 122 of a conduit 40, the half-sections 56, 58 will not likely spread apart in a uniform manner. In other words, the washers 113, 115 which are positioned about the three bolts 94 will not likely be compressed in unison as the groove sidewalls 50, 52 are forced apart as they slide (e.g.

downwardly) about and roll along the outer surface 122 of the conduit 40. However, the more of the shoe groove 36 that is rolled along the outer surface 122 of the conduit 40, the more the washers 113, 115 which are positioned about the several bolts 94 will be effected (i.e. compressed) during a conduit bending operation.

It follows from the foregoing that a conduit bending apparatus 20 has been described which embodies a conduit bending shoe 24 comprised of two half-sections 56, 58 having arcuate peripheries 64 which collectively provide a conduit-accepting groove 36 having an original, or unexpanded, width W which is capable of expanding and ultimately closely accepting the outer surface 122 of a conduit 40 (FIGS. 10 and 11) whose outer diameter is greater than the original width W. To this end, one half-section 56 provides one sidewall 50 of the groove 36 while the other half section 58 provides the other sidewall 52 of the groove 96. Meanwhile, biasing means 80, in the form of spring washers 113, 115 are positioned about the shanks 92 of the bolts 94 used to secure the half-sections 56 and 58 together so that the half-sections 56, 58 are continually biased from the FIG. 11 expanded, or spaced-apart, condition toward the FIG. 10 unexpanded condition at which the opposing surfaces 60 of the half-sections 56 and 58 engage one another. As the sidewalls 50, 52 of the groove 36 are forced to spread apart as the sidewalls 50, 52 are urged downwardly (in the direction of the FIG. 10 arrow 120) along the outer surface 122 of the conduit 40, the half-sections 56, 58 are forced to move apart (in opposition to the biasing force of the spring washers 113, 115) so that the width of the groove 36 (as measured laterally across the opening of the groove 36) expands so that the conduit 40 can be closely accepted by the groove 36, as is depicted in FIG. 11.

By way of example, applicants have constructed a shoe 24 with a first pair of spring washers 113 and a second pair of spring washers 115 which are capable of collapsing through a distance of 0.38 inches. Therefore, the groove 36 of such a constructed shoe 24 will accommodate a conduit 40 whose width is 0.38 inches larger than the original, or unexpanded, width W of the groove 36. It can therefore be said that the groove 36 of such a constructed shoe 24 is capable of closely accepting the outer surface 122 of a conduit 40 having an outer diameter which measures between W and 0.38 inches larger than the original groove width W.

It will be understood that numerous modifications and substitutions can be had to the aforedescribed embodiment without departing from the spirit of the invention. For example, although the aforedescribed embodiment 20 has been shown and described as including two pairs of spring washers 113, 115 for biasing the half-sections 56, 58 toward one another as the groove sidewalls 50, 52 are forced to spread apart as the sidewalls 60, 62 are forced downwardly upon (or across) the outer surface 122 of a conduit 40 whose outer diameter is greater than the original width W of the groove 36, a conduit bending shoe can posses an alternative number of spring washers whose biasing strength is different (i.e. greater or lesser) than those of the aforedescribed washers 113, 115. Such an alternative number of washers may be desired if the spacing as measured along the shank 92 of the bolt 94 between the bolt head 96 and the nut 95 is desired to be increased or decreased; and washers having an alternative biasing strength than those of the washers 113 or 115 can be utilized if the strength needed to spread the half-sections 56, 58 apart is desired to be altered.

Figure 12:
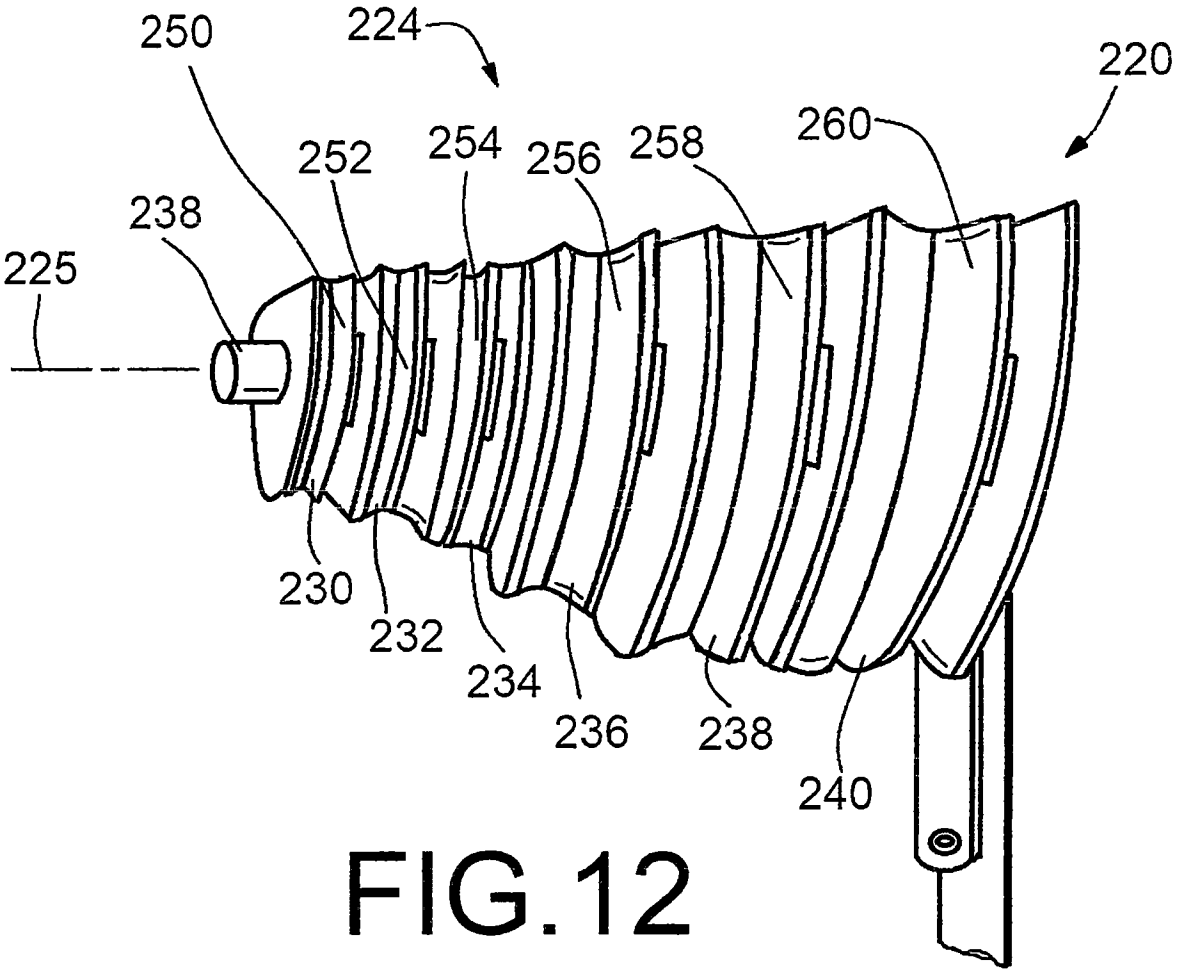
FIG. 12 is a perspective view of a fragment of an alternative conduit bending apparatus within which a series of width-expandable shoes possessing conduit-accepting grooves of alternative sizes are incorporated.

Furthermore and with reference to FIG. 12, there is illustrated an alternative conduit bending apparatus, generally indicated 220, having a conduit bending shoe assembly, generally indicated 224, which is supported about and slaved to a cylindrical load bar 238 for rotation about a rotation axis 225. The shoe assembly 224 of the depicted apparatus 220 includes a series of width-expandable shoes 230, 232, 234, 236, 238 and 240 wherein each shoe 230, 232, 234, 236, 238 or 240 possesses a construction similar to that of the shoe 24 of FIG. 1. In particular, each shoe 230, 232, 234, 236, 238 or 242 possesses two half-sections which collectively define an outwardly-opening groove 250, 252, 254, 256, 258 or 260, respectively, and each groove 250, 252, 254, 256, 258 or 260 has an original, or unexpanded, width which is different from (i.e. larger or smaller) than the original width of every other groove 250, 252, 254, 256, 258 or 260 in the series of shoes 230, 232, 234, 236, 238 and 240. It therefore follows that the series of shoes 230, 232, 234, 236, 238 and 240 depicted in FIG. 12 provides an operator with the capacity to bend a large number of conduits having any outer diameter with falls within a relatively large range of different outer diameters. Thus, the apparatus 220 is likely to obviate the need that an operator have on hand a separate conduit bending shoe for every size of conduit that he may be required to bend and is advantageous in this respect.

Furthermore, although the biasing means 80 of the aforedescribed apparatus 20 has been described as taking the form of spring washers 113, 115, such biasing means can take an alternative form, such as that of a compression spring or an elastomeric member (e.g. a washer) which possesses an inherent resiliency to return to an undeformed condition when compressed. When suitably arranged between the half-sections 56 and 58, these alternative forms of biasing means are capable of performing the same biasing function as that of the spring washers 113, 115.

Accordingly, the aforedescribed embodiments 20 and 220 are intended for the purpose of illustration and not as limitation.

The invention claimed is:

1. In a conduit bending apparatus having a conduit-bending shoe mounted for rotation about an axis and having an arcuate-shaped periphery defining an outwardly-opening groove having opposing sidewalls for accepting an outer surface of a conduit to be bent having a predetermined outer diameter and wherein the outwardly-opening groove has a width as measured laterally across an opening thereof and which is sized to accept the outer surface of the conduit so that by positioning the outwardly-opening groove of the conduit-bending shoe about the conduit so that the outer surface of the conduit is accepted by the outwardly-opening groove and then pressing the shoe against the conduit while rotating the shoe about the axis so that the outwardly-opening groove rolls along a length of the conduit, a bend is formed in the conduit, the improvement characterized in that:

the outwardly-opening groove is provided by a plurality of sections arranged adjacent each other and forming the arcuate-shaped periphery, said plurality of sections including two half-sections configured to move relative to each other along the axis;

the outwardly-opening groove has a width configured to expand to accept one conduit having a diameter which is greater than the predetermined outer diameter; and the improvement further comprising biasing means for continually biasing the two half-sections toward each other, such that when the two half-sections are pressed against the one conduit, the two half-sections are forced to spread apart in opposition to a force of the biasing means.

2. The improvement as defined in claim 1 wherein the two half-sections form the opposing sidewalls of the outwardly-opening groove and the opposing sidewalls are adapted to move toward and away from one another to accommodate an alteration in the width of the outwardly-opening groove.

3. The improvement as defined in claim 1 wherein the width of the outwardly-opening groove is configured to expand by pressing the sidewalls of the groove against the outer surface of the one conduit, thereby forcing the opposing sidewalls of the groove to spread apart so that the width of the outwardly-opening groove accepts the outer surface of the one conduit; and wherein the outwardly-opening groove has an imaginary mid-plane arranged substantially midway between the opposing sidewalls of the outwardly-opening groove, and one of the two half-sections is disposed on one side of the mid-plane, and the other of the two half-sections is disposed on an opposite side of the mid-plane.

4. The improvement as defined in claim 3 wherein the two opposing sidewalls of the outwardly-opening groove having two opposing surfaces which, when the two half-sections are joined together, face one another.

5. The improvement as defined in claim 4 wherein the one of the two half-sections defines one of the two opposing sidewalls of the outwardly-opening groove and the other of the two half-sections defines the other of the two opposing sidewalls of the outwardly-opening groove, and the two half-sections are joined to one another in a manner which accommodates movement of the two opposing sidewalls relative to one another to thereby alter the width of the outwardly-opening groove between an expanded condition and an unexpanded condition.

6. The improvement as defined in claim 5 wherein the two half-sections define a set of aligned through-openings which extend through the two half-sections along a path which is substantially parallel to the axis of the shoe, and the two half-sections are joined together with a bolt having a shank which extends through the set of aligned through-openings.

7. The improvement as defined in claim 6 wherein the biasing means includes a spring having a central opening through which the shank of the bolt extends and two opposite ends which are spaced from one another along the shank of the bolt, and the spring is adapted to resist compression forces acting upon the two opposite ends.

8. The improvement as defined in claim 6 wherein the biasing means includes at least one spring washer having a central opening through which the shank of the bolt extends.

9. In a conduit bending apparatus having a conduit-bending shoe which is mounted for rotation about an axis and having an arcuate-shaped periphery defining an outwardly-opening groove which extends there-along and having two opposing sidewalls for accepting an outer surface of a conduit to be bent having a predetermined outer diameter and wherein the outwardly-opening groove has a width as measured laterally across the opening thereof which is sized to accept the conduit so that by positioning the outwardly-opening groove of about the outer surface of the conduit and then pressing the conduit-bending shoe against the conduit while rotating the conduit-bending shoe about the axis of rotation so that the outwardly-opening groove rolls axially along the conduit, a bend is formed in the conduit, the improvement characterized in that:

the width of the outwardly-opening groove of the conduit-bending shoe is capable of expanding from an unexpanded condition toward an expanded condition for accepting a conduit having an outer diameter which is greater than the predetermined outer diameter; and the shoe further includes biasing means for biasing the width of the outwardly-opening groove from the expanded condition toward the unexpanded condition.

10. The improvement as defined in claim 9 wherein the conduit-bending shoe has an imaginary mid-plane which bisects the outwardly-opening groove between the opposing sidewalls thereof, and the conduit-bending shoe includes a platen half-section which is arranged on one side of the mid-plane and includes another platen half-section which is arranged on an opposite side of the mid-plane;

the platen half-sections collectively form the outwardly-opening groove which extends along the arcuate-shaped periphery of the conduit-bending shoe; and the platen half-sections are joined together in a manner which accommodates a spreading apart of the platen half-sections at the outer periphery of the conduit-bending shoe so that as the platen half-sections are spread apart, the width of the outwardly-opening groove expands by a corresponding amount.

11. The improvement as defined in claim 10 wherein the platen half-sections define at least one set of aligned through-openings which extend through the platen half-sections along a path which is substantially parallel to the axis of the shoe, and the platen half-sections are joined together with a bolt having a shank which extends through the at least one set of aligned through-openings and a nut which is threaded about the shank of the bolt.

12. The improvement as defined in claim 11 wherein the biasing means includes a spring washer having a central opening through which the shank of the bolt extends.

13. The improvement as defined in claim 9 wherein the biasing means includes a spring for continually urging the two opposing sidewalls of the outwardly-opening groove toward one another so that when the opposing sidewalls of the groove are urged against the outer surface of the conduit having an outer diameter which is greater than the predetermined outer diameter, the opposing sidewalls of the outwardly-opening groove are forced apart in opposition to a biasing force of the spring.

14. The improvement as defined in claim 13 wherein the biasing means includes a plurality of spring washers which are positioned about the shank of the bolt which extends through the at least one set of aligned through-openings for acting between a head of the bolt and the nut.

15. The improvement as defined in claim 10 wherein the platen half-sections define a plurality of sets of aligned through-openings which extend through the half-sections along paths which are substantially parallel to the axis of the shoe, and the platen half-sections are joined together with bolts wherein each bolt has a shank which extends through a corresponding set of the plurality of sets of aligned through-openings, and a nut is threaded about the shank of each bolt opposite a head thereof so that the platen half-sections are captured between the heads of the bolts and the nuts threaded thereon.

16. The improvement as defined in claim 15 wherein the biasing means includes a plurality of spring washers which are positioned about the shank of each bolt which extends through a corresponding set of the plurality of sets of aligned through-openings for acting between the head of each bolt and each nut which is threaded about the shank of each bolt.

17. The improvement as defined in claim 9 wherein the rotation of the conduit-bending shoe about the rotation axis is powered cordlessly.

18. In a method for bending a cylindrical conduit with a conduit-bending shoe mounted for rotation about an axis and having an arcuate-shaped periphery defining an outwardly-opening groove having two opposing sidewalls for accepting an outer surface of a conduit to be bent having a predetermined outer diameter and wherein the outwardly-opening groove has a width as measured laterally across the opening thereof and which is sized to accept the outer surface of the conduit so that by positioning the conduit-bending shoe against the conduit so that the outer surface of the conduit is accepted by the outwardly-opening groove and then pressing the outwardly-opening groove of the conduit-bending shoe against the conduit while rotating the conduit-bending shoe about the axis so that the outwardly-opening groove rolls along a length of the conduit, a bend is formed in the conduit, the improvement characterized in that:

the step of pressing the outwardly-opening groove of the conduit-bending shoe against the conduit includes a simultaneous step of expanding the width of the outwardly-opening groove of the shoe to enable the groove to accept an outer surface of a conduit having a diameter which is greater than the predetermined outer diameter.

19. The improvement as defined in claim 18 wherein the step of expanding the width of the outwardly-opening groove includes pressing the two opposing sidewalls of the outwardly-opening groove against the outer surface of the conduit having an outer diameter which is greater than the predetermined outer diameter thereby forcing the opposing sidewalls of the outwardly-opening groove to spread apart.

* * * * *